US009572435B2

(12) United States Patent
Hondros et al.

(10) Patent No.: US 9,572,435 B2
(45) Date of Patent: Feb. 21, 2017

(54) CHILD BOOSTER SEAT WITH SWIVEL CAPABILITY

(71) Applicant: Graco Children's Products Inc., Atlanta, GA (US)

(72) Inventors: Bradley Keith Hondros, Atlanta, GA (US); Brandon Seth Cross, Atlanta, GA (US)

(73) Assignee: Graco Children's Products Inc., Atlanta, GA (US)

( * ) Notice: Subject to any disclaimer, the term of this patent is extended or adjusted under 35 U.S.C. 154(b) by 0 days.

(21) Appl. No.: 14/643,825

(22) Filed: Mar. 10, 2015

(65) Prior Publication Data

US 2015/0296987 A1 Oct. 22, 2015

Related U.S. Application Data

(60) Provisional application No. 62/008,908, filed on Jun. 6, 2014, provisional application No. 61/950,818, filed on Mar. 10, 2014.

(51) Int. Cl.

| | |
|---|---|
| ***A47D 1/00*** | (2006.01) |
| ***A47C 3/18*** | (2006.01) |
| ***A47D 1/10*** | (2006.01) |

(52) U.S. Cl.

CPC ..... *A47D 1/002* (2013.01); *A47C 3/18* (2013.01); *A47D 1/008* (2013.01); *A47D 1/103* (2013.01)

(58) Field of Classification Search

CPC ..... A47C 3/18

USPC ..... 297/344.21, 344.22

See application file for complete search history.

(56) References Cited

U.S. PATENT DOCUMENTS

| | | | | |
|---|---|---|---|---|
| 5,599,065 | A * | 2/1997 | Gryp | A47C 3/18 248/425 |
| 5,810,441 | A * | 9/1998 | Ezuka | B60N 2/143 297/344.22 |
| 6,575,420 | B2 * | 6/2003 | Yoshida | B60N 2/14 248/349.1 |
| 7,559,606 | B2 * | 7/2009 | Hei | B60N 2/2806 297/130 |
| 7,575,276 | B1 * | 8/2009 | Henry | B60N 2/2821 297/256.12 |
| 8,480,173 | B2 * | 7/2013 | Huang | A61G 7/1003 297/344.21 |
| 2009/0039692 | A1 * | 2/2009 | Tuckey | A47D 1/008 297/344.22 |
| 2010/0181808 | A1 | 7/2010 | Medeiros et al. | |
| 2010/0253123 | A1 * | 10/2010 | DeCraene | B60N 2/14 297/344.22 |
| 2011/0193390 | A1 * | 8/2011 | Hsiao | B60N 2/146 297/344.22 |

* cited by examiner

*Primary Examiner* — Timothy J Brindley
(74) *Attorney, Agent, or Firm* — Sutherland Asbill & Brennan LLP

(57) ABSTRACT

A child booster seat has a base assembly, a seat carried by part of the base assembly, and an actuator. The seat can swiveled between at least two different rotational seat facing orientations and can be selectively latched in either one of the at least two different seat facing orientations. The seat can be unlatched using one hand by moving the actuator and can be reoriented by swiveling the seat using the same one hand.

11 Claims, 12 Drawing Sheets

CHILD BOOSTER SEAT WITH SWIVEL CAPABILITY

RELATED APPLICATION DATA

This patent is related to and claims priority benefit of U.S. provisional application Ser. Nos. 62/008,908 filed Jun. 6, 2014 and 61/950,818 filed Mar. 10, 2014, each entitled "Child Booster Seat with Swivel Capability." The entire contents of these prior filed provisional applications are hereby incorporated herein by reference.

BACKGROUND

1. Field of the Disclosure

The present disclosure is generally directed to booster seats for children, and more particularly to a child booster seat that can swivel among a plurality of seat facing orientations once mounted to a chair or surface.

2. Description of Related Art

Booster seats for children are known in the art. Such booster seats are typically configured to be mounted on or resting on the seat bottom of a conventional chair. A child is then seated in the booster seat, raising the child higher up than if seated directly on the chair set bottom. The booster seat and chair are often then pushed up to the edge of a table at which the caregiver is seated. Sometimes, the booster seat may be provided with its own dedicated tray to provide the child with an eating or play surface while seated in the booster seat.

It can be difficult to lift and remove a child from a booster seat. This is particularly true when the chair and the booster seat are pushed up to a table's edge and/or when the booster seat is provided with a tray for the child. The caregiver must typically lift the child and remove them from the side of the booster seat. This is because the table and/or the tray are often in the way at the front of the booster seat. The caregiver may have to move the chair and the booster seat, with the weight of the child included, to remove the child more easily. This can be difficult with the child still seated in the seat. Removing the child from the booster seat from the side of the booster seat can be awkward because the sides are typically blocked by armrests. The caregiver and child are both put in an awkward position while lifting the child out of the seat from the side of the booster seat.

Some booster seats have been known to have a swiveling seat function. These types of seats are no longer being commercially sold. These prior known booster seats had a button or buttons that one would push to release a latching mechanism. The seat could then be rotated or repositioned with the other hand. This was because the actuating mechanism button or buttons were provided on the stationary part of the booster seat. Swiveling was thus a cumbersome two-handed operation. It would be impossible for a caregiver to swivel the seat orientation while holding their child or while holding other objects. There are other types of seats that can swivel, such as barber chairs, bar stools, and the like.

SUMMARY

In one example according to the teachings of the present disclosure, a child booster seat has a base assembly, a seat carried by part of the base assembly, and an actuator. The seat can swiveled between at least two different rotational seat facing orientations and can be selectively latched in either one of the at least two different seat facing orientations. The seat can also be unlatched using one hand by moving the actuator and can be reoriented by swiveling the seat using the same one hand.

In one example, the seat can rotate relative to a stationary base part of the base assembly when swiveled.

In one example, the child booster seat can include a swivel mechanism with two or more of the actuators and two or more latch mechanisms each having an associated one of the two or more actuators. The two latch mechanisms can be positioned on opposite sides of the child booster seat. Both of the two latch mechanisms can be released or disengaged by actuating with one hand any selected one of the two or more actuators.

In one example according to the teachings of the present disclosure, a child booster seat has a base assembly with a stationary base part and a swivel base part coupled to the stationary base part. A seat is carried on the swivel base part. The seat and swivel base part are rotatable relative to the stationary base part between at least two different seat facing orientations. A latch system has at least one latch mechanism and has two or more actuators spaced apart on the child booster seat. Each actuator is operably coupled to the at least one latch mechanism. When any selected actuator of the two or more actuators is actuated, the at least one latch mechanism is released allowing the seat to be swiveled relative to the stationary base part.

In one example, the child booster seat can include two of the latch mechanisms disposed generally opposite one another on a portion of the child booster seat. Each of the two latch mechanism can have one of the two or more actuators operably coupled thereto.

In one example, the stationary base part can be a lower base part and the swivel base part can be an upper base part mounted on a top side of the stationary base part.

In one example, the seat and the swivel base part can be supported by the stationary base part.

In one example, any selected one of the two or more actuators can be actuated with one hand whereby the seat can be rotated with the one hand.

In one example, the latch system can include a circumferential latch ring. The latch ring can carry a cam pen of the at least one latch mechanism. A latch pin can be seated in the cam pen whereby actuation of any selected one of the two or more actuators can move the latch ring and the cam pen which in turn can move the latch pin.

In one example, the latch system can include a latch ring that carries a cam pen. The latch ring and cam pen can be formed as one contiguous integral part or as two or more separate assembled parts.

In one example, the child booster seat can include two of the latch mechanisms and two of the actuators. One of the two actuators can be operably coupled each respective one of the latch mechanisms.

In one example, the child booster seat can include a latch ring carrying two cam pens, one cam pen for each of two latch mechanisms. The latch ring can be operably coupled to each of the two or more actuators. The child booster seat can include two latch pins, one seated in each of the cam pens. Ramp surfaces can be provided on the cam pens and can be configured to move the corresponding latch pins between a latched position and an unlatched position by selectively actuating a selected one of the two actuators.

In one example, the latch system can include a circumferential latch ring captured between the stationary base part and the swivel base part.

In one example according to the teachings of the present disclosure, a child booster seat has a base assembly with a stationary base part and a swivel base part coupled to the stationary base part. A seat is carried on the swivel base part. The seat and swivel base part are rotatable relative to the stationary base part between at least two different seat facing orientations. A latch system has a plurality of latch mechanisms and a plurality of actuators. Each of the plurality of latch mechanisms has one of the plurality of actuators operably couple thereto. The plurality of actuators is spaced apart on the child booster seat. When any selected actuator of the plurality of actuators is actuated, the plurality of latch mechanisms is released allowing the seat to be swiveled relative to the stationary base part.

In one example, the plurality of latch mechanisms can include two latch mechanism disposed opposite one another on the base assembly.

In one example, the latch system can include a latch ring captured between the stationary base part and the swivel base part over a track ring on the stationary base part.

In one example, each of the plurality of actuators can be fixed to a portion of a latch ring and can be exposed on an exterior of the base assembly.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present disclosure is directed to a child booster seat that can swivel among multiple seat facing orientations. The child booster seat can swivel once mounted to a chair or other surface. The disclosed child booster seat has a seat that is supported on a base assembly whereby the seat can swivel about part of the base assembly from a forward facing orientation or direction. The disclosed child booster seat can swivel at least 90 degrees to one side, the other side, or optionally and selectively to both sides from the forward facing orientation. The disclosed child booster seat makes it easier for a caregiver to place a child in the seat and to remove a child from the seat without having to move a table or to move the chair supporting both the booster seat and a child seated in the seat. The disclosed child booster seat is configured to lock or latch the seat in a selected one of at least to different seat facing orientations. The disclosed child booster seat can be unlocked or released and rotated or swiveled using only one hand. These and other objects, features, and advantages of the disclosed child booster seat will become apparent to those having ordinary skill in the art upon reading this disclosure.

Figure 1:
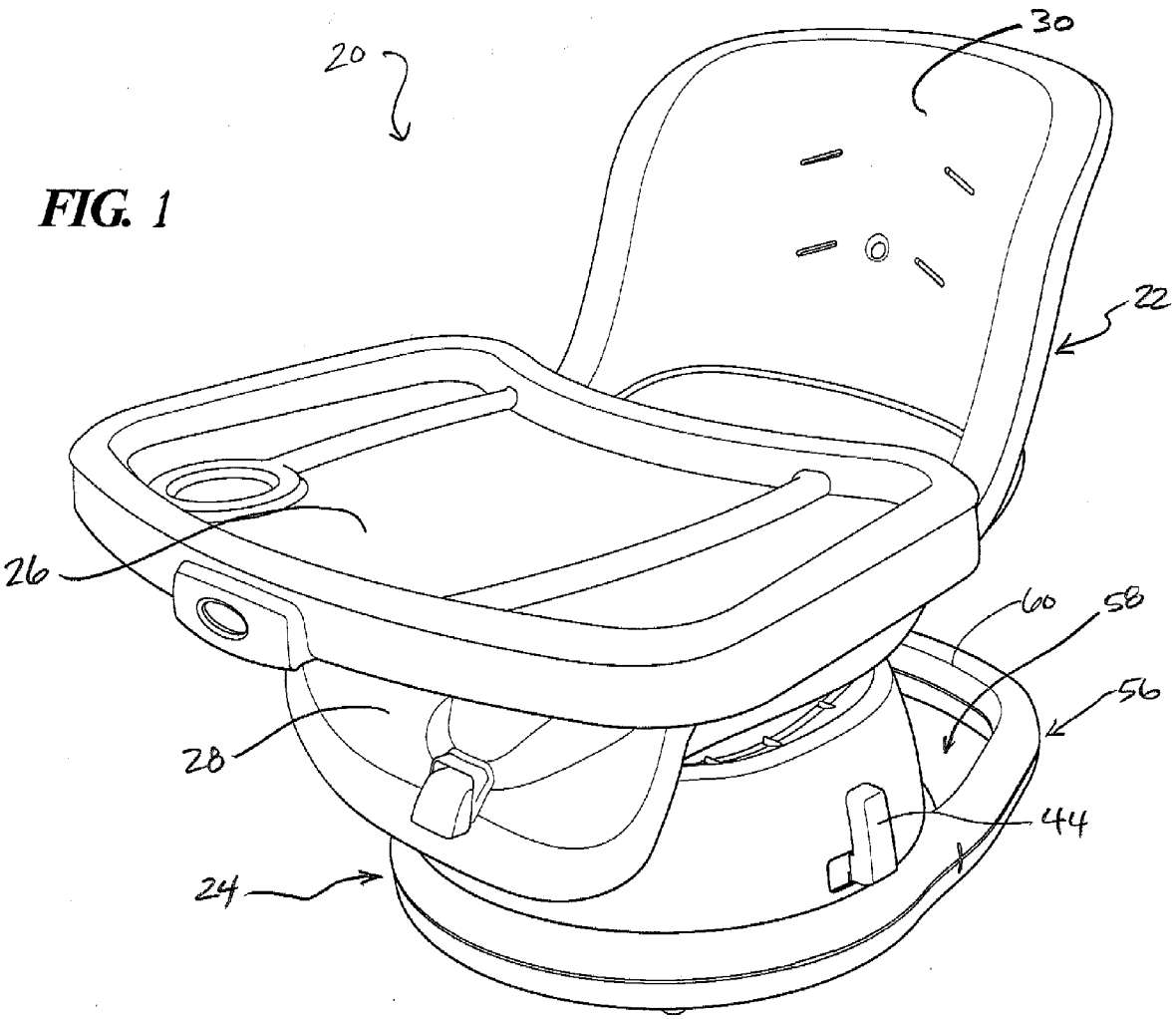
FIG. 1 shows a front and side perspective view of one example of a child booster seat constructed in accordance with the teachings of the present disclosure, the seat shown in a forward facing seat orientation.
Figure 2:
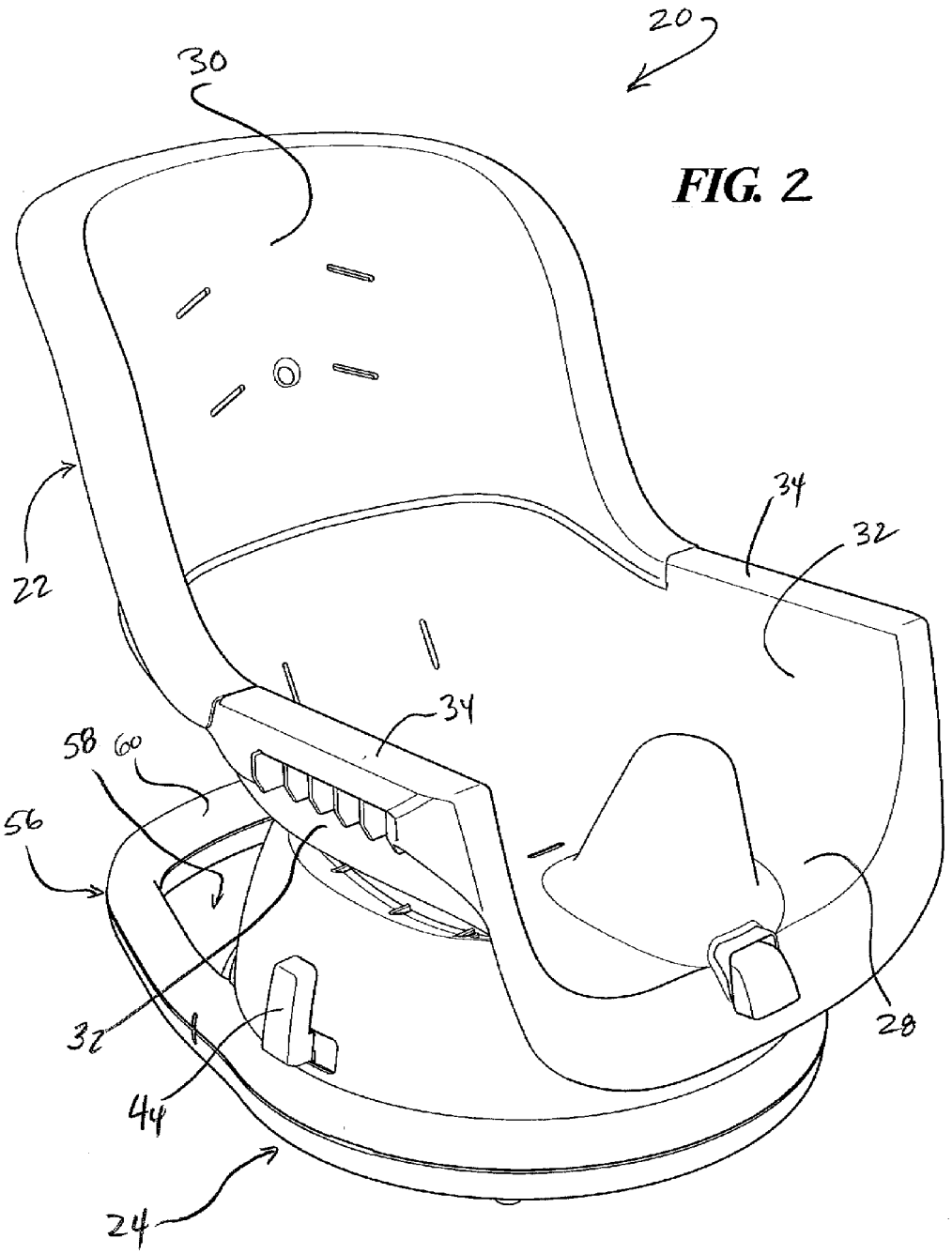
FIG. 2 shows a front and opposite side perspective view of the child booster seat of FIG. 1 and with a child tray removed.

Turning now to the drawings, FIG. 1 shows one example of a child booster seat 20 (hereinafter "the booster seat 20") constructed in accordance with the teachings of the present disclosure. In the disclosed example, the booster seat 20 generally has a seat 22 supported by or carried on a base assembly 24. The base assembly 24 is configured to rest on a support surface such as a chair seat bottom (not shown) or other support surface. The booster seat 20 can have accessories or optional features that have little to no bearing on the present disclosure. For example, the booster seat 20 can employ a safety harness (not shown) to aid in securing an occupant tot eh seat 22. As another example, the booster seat 20 can also have a child tray 26 that is removably connected to the seat 22 or the booster seat 20. FIG. 2 shows the booster seat 20 with the child tray 26 having been removed. The seat 22 can also vary in configuration and construction from the example shown and described herein. However, the seat will typically have a seat bottom portion 28 and a seat back portion 30. The seat 22 can also have side walls 32 that define arm rests 34 at the top of the walls for the occupant of the seat. In one example, the child tray 26 is removably connectable to the arm rests 34 and/or the side walls 32. The seat 22 can be a one-piece shell or can be formed of two or more parts. The seat back portion 30 may be movable or reclinable relative to the seat bottom portion 28.

Figure 3:
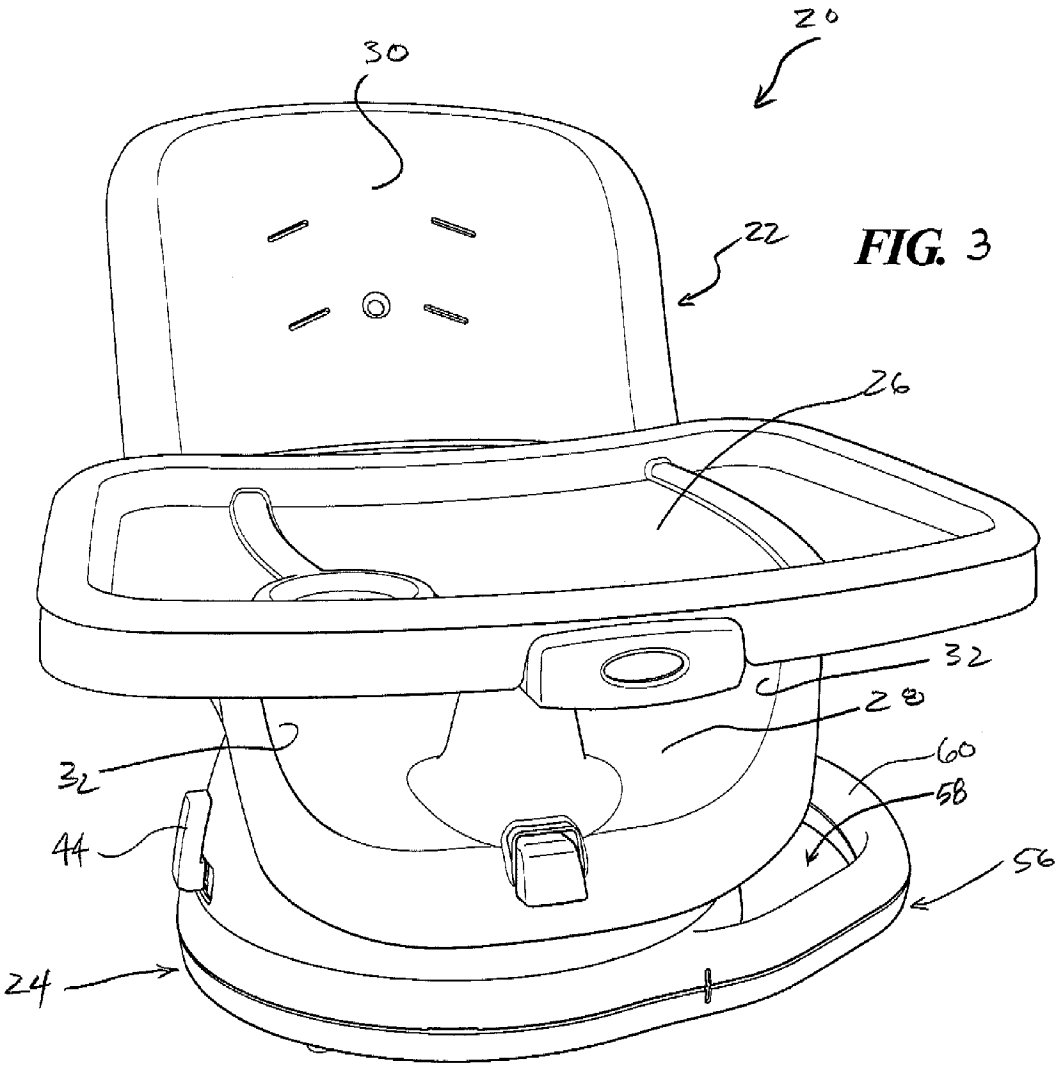
FIG. 3 shows the child booster seat of FIG. 1 but with the seat swiveled or rotated 90 degrees to a side facing seat orientation.

In the disclosed example, the booster seat 20 has swivel capability. In other words, the seat 22 can be swiveled about or relative to at least part of the base assembly 24 between at least two different seat facing orientations, such as from a forward facing seat orientation (see FIGS. 1 and 2) to a side facing seat orientation (see FIG. 3). In this example, the seat 22 can be swiveled to either side, i.e., to a left facing or a right facing seat orientation. In one example, the seat can be selectively swiveled to additional seat facing orientations, as desired, such as a rear seat facing orientation and/or one or more intermediate seat facing orientations between the front facing orientation, either of the left and right side facing orientation, and/or the rear facing orientation. The seat 22 in the disclosed example can thus be swiveled between at least two different rotational seat facing directions or orientations.

Figure 4:
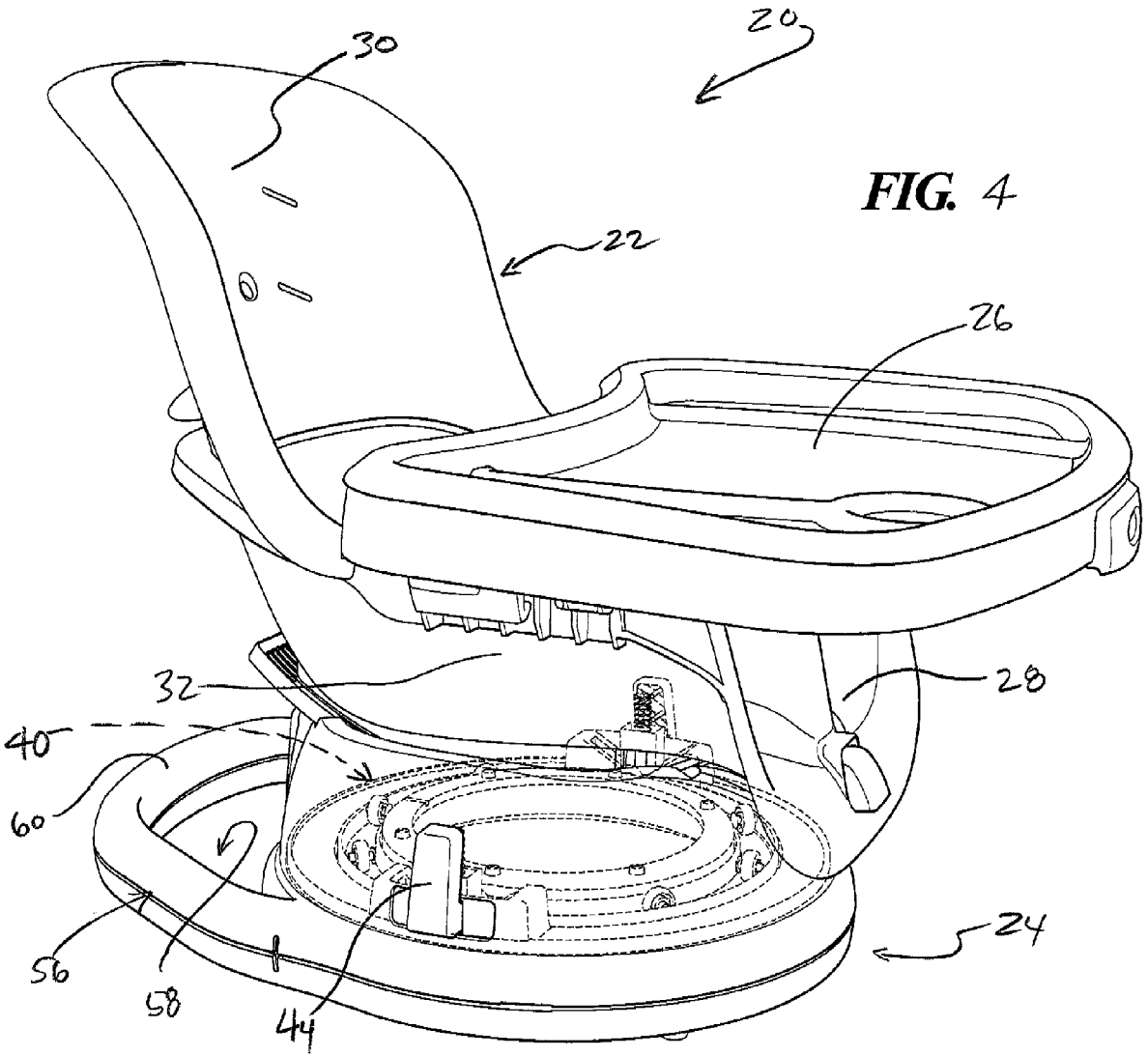
FIG. 4 shows a side view of the child booster seat of FIG. 1 and depicting internal components of the swivel mechanism in phantom view.
Figure 5:
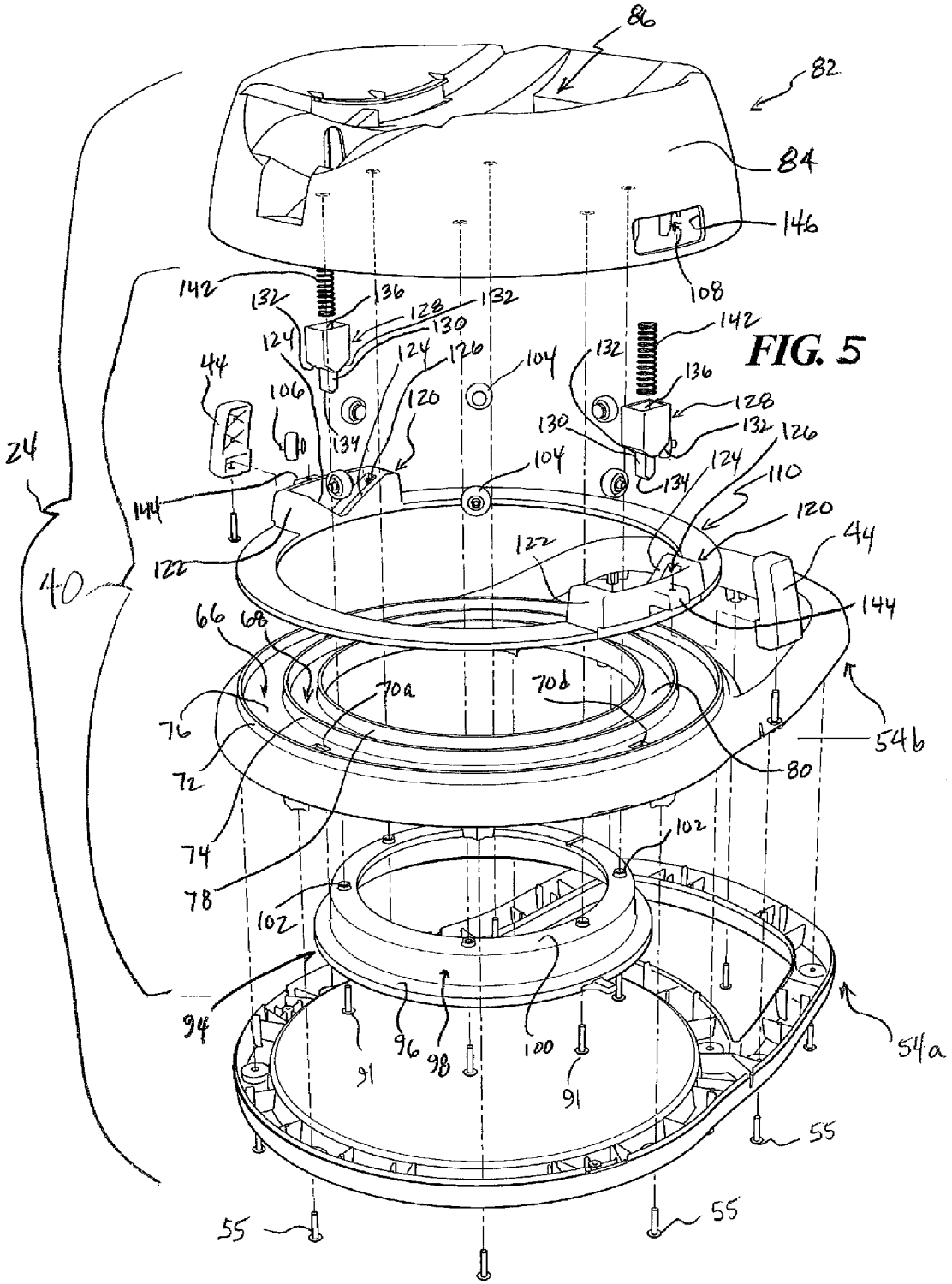
FIG. 5 shows an exploded view of the base assembly of the child booster seat of FIGS. 1-4.
Figure 6:
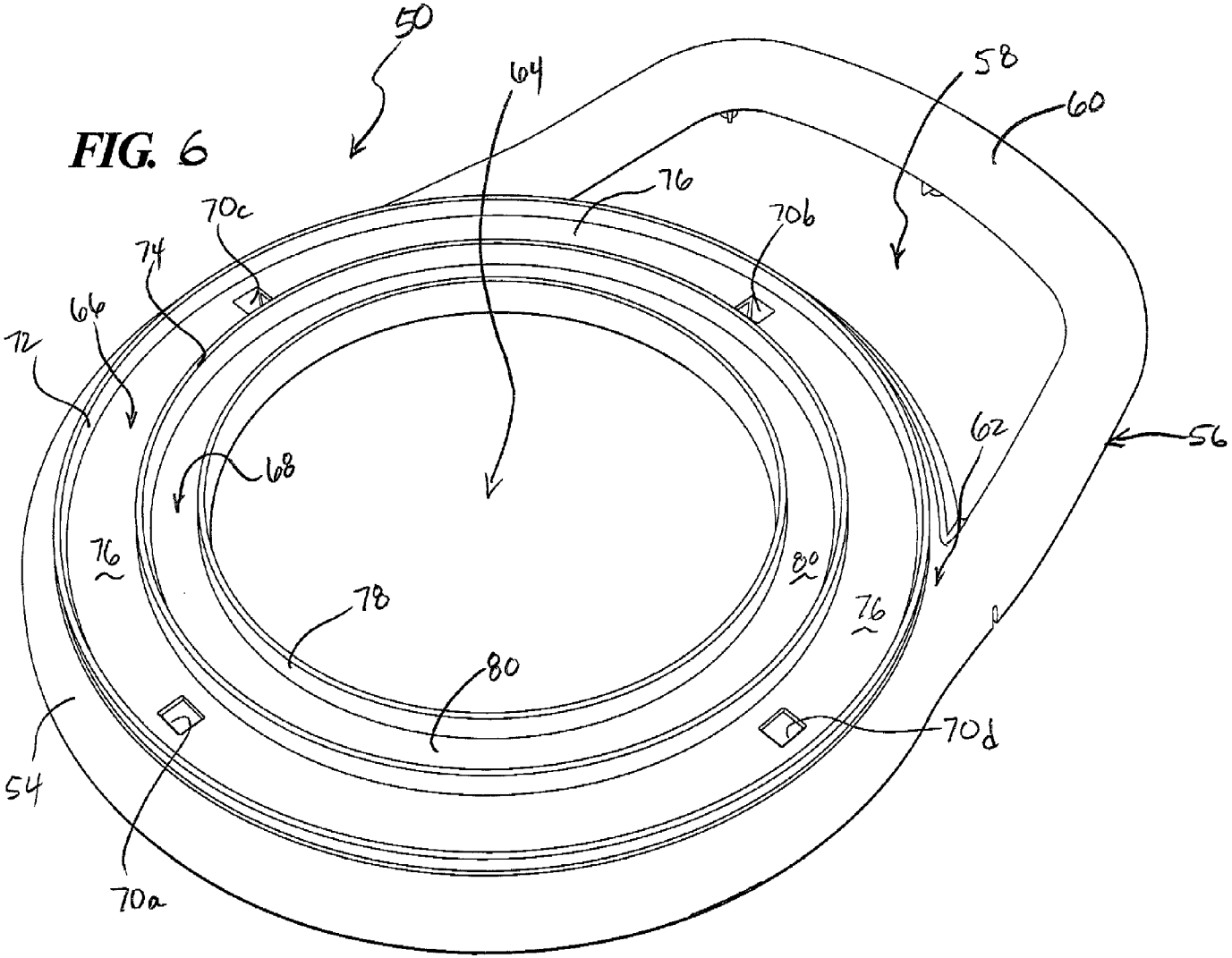
FIG. 6 shows the lower or stationary base part of the base assembly depicted in FIGS. 1-5 with much of the swivel mechanism and with the upper or swivel base part having been removed.

As discussed in detail below and as generally depicted in FIGS. 4 and 5, the booster seat 20 has a swivel mechanism 40 employed to permit a user to swivel the seat 22, i.e., to permit the user to change or reorient the seat facing direction of the seat. The disclosed swivel mechanism 40 is configured to permit the seat 22 to be selectively swiveled between and latched or retained in either one of at least two different seat facing orientations or directions. The disclosed swivel mechanism 40 can also permit a user to selectively release or unlatch the seat 22 using one hand, and to then swivel and reorient the seat using the same hand. In one example, the seat 22 can rotates relative to at least part of the base assembly 24 when swiveled. In one example, the swivel mechanism 40 can have a latch system with one, two, or more latch mechanisms 42. Each latch mechanism 42 can have an actuator 44, i.e., a handle, lever, button, or the like, exposed on the exterior of the base assembly 24. In one example employing two of the latch mechanisms 42, the latch mechanisms can be positioned on opposite sides of the booster seat 20. The two or more latch mechanisms 42 can be released or disengaged by actuating any one of the exposed actuators 44 with one hand. The seat 22 can then be reoriented by the user holding the same actuator 44.

Details of one example of the swivel mechanism 40 and latch mechanisms 42 are now described below with reference to FIGS. 5-8. In the disclosed example, the base assembly 24 has a stationary part 50 shown in FIGS. 5 and 6 and has a swivel part 52 best shown in FIGS. 5 and 8 that can swivel or rotate relative to the stationary part. The seat 22 is carried on or by, or otherwise coupled or connected to, the swivel part 52 allowing the seat to swivel between the selectable seat facing orientations. The seat 22 can be reclinable relative to the base assembly 24, if desired. The seat 22 can be attached, coupled, or connected to a portion of the base assembly 24 in any number of ways, also as desired. The seat 22 can be secured to part of the base assembly 24 using fasteners, brackets and fasteners, latch and release components, or the like. The seat 22 can be configured to be selectively removable from and attachable to the base assembly 24 by the consumer or user. Alternatively, the seat 22 can be configured to be attached to the base assembly 24 in a way such that the seat is not intended to be removed from the base assembly without harming or destroying the booster seat 20.

The lower base part or stationary base part 50 has a body 54 formed as two parts secured together by fasteners 55 (see FIG. 5). The two parts 54*a*, 54*b* can be separately fabricated and then attached to one another to form the body 54. The body 54 has a bottom side that rests on a support surface or chair. The stationary part 50 also has a protruding element 56 that protrudes from a back side of the body 54. The protruding element 56 is C-shaped and forms a side opening 58 between a handle bar 60 of the element and the body 54. The protruding element 56 can perform a number of functions. For one, the handle bar 60 can be gripped and used as a carry handle for the booster seat 20. The protruding element 56 can also act as a spacer, if desired, to space the seat 22 away from a back support of a chair on which the booster seat 20 rests, providing clearance for the seat 22 to swivel. The protruding element 56 can also be used as a securing device to securely mount the booster seat 20 to a chair. The side opening 58 can be nested over the back support of a chair. Alternatively, one or more straps can be threaded through the side opening 58 to tether the base assembly 24 to the chair.

The body 54 of the stationary base part 50 in this example is a circular ring shape and also has a top side 62 and a central opening 64 through the body. The stationary base part 50 can be molded or otherwise formed as a one-piece integral structure or can be formed of several assembled parts. In either case, the body 54 can define a circumferential track arrangement on the top side 62, whether as an integral part of the body or by one or more pieces added to the body. In this example, the track arrangement on the top side 62 defines has an outer track ring 66 or latch track and an inner race ring 68 or swivel track spaced radially inward of the outer track ring. The central opening 64 is defined radially within the inner race ring 68. The outer track ring 66 in this example has four slots, holes, or latch openings 70*a-d* spaced equidistant around the track ring. One latch opening 70*a* is centered at the front, one latch opening 70*b* is centered at the back, and two latch openings 70*c*, 70*d* are centered on the opposed sides of the stationary base part 50. Each latch opening 70*a-d* is about 90 degrees from the other in this example The outer track ring 66 is bounded on the radially outward side by an outer wall 72 and on the radially inward side by an intermediate wall 74. The walls 72, 74 protrude upward relative to an upward facing track surface 76 of the outer track ring 66 that lies between the two walls. Likewise, the inner race ring 68 is bounded on the radially outward side by the intermediate wall 72 and on the radially inward side by an inner wall 78. The walls 74, 78 protrude upward relative to an upward facing race surface 80 of the inner race ring 68 that lies between the two walls 74, 78.

Figure 7:
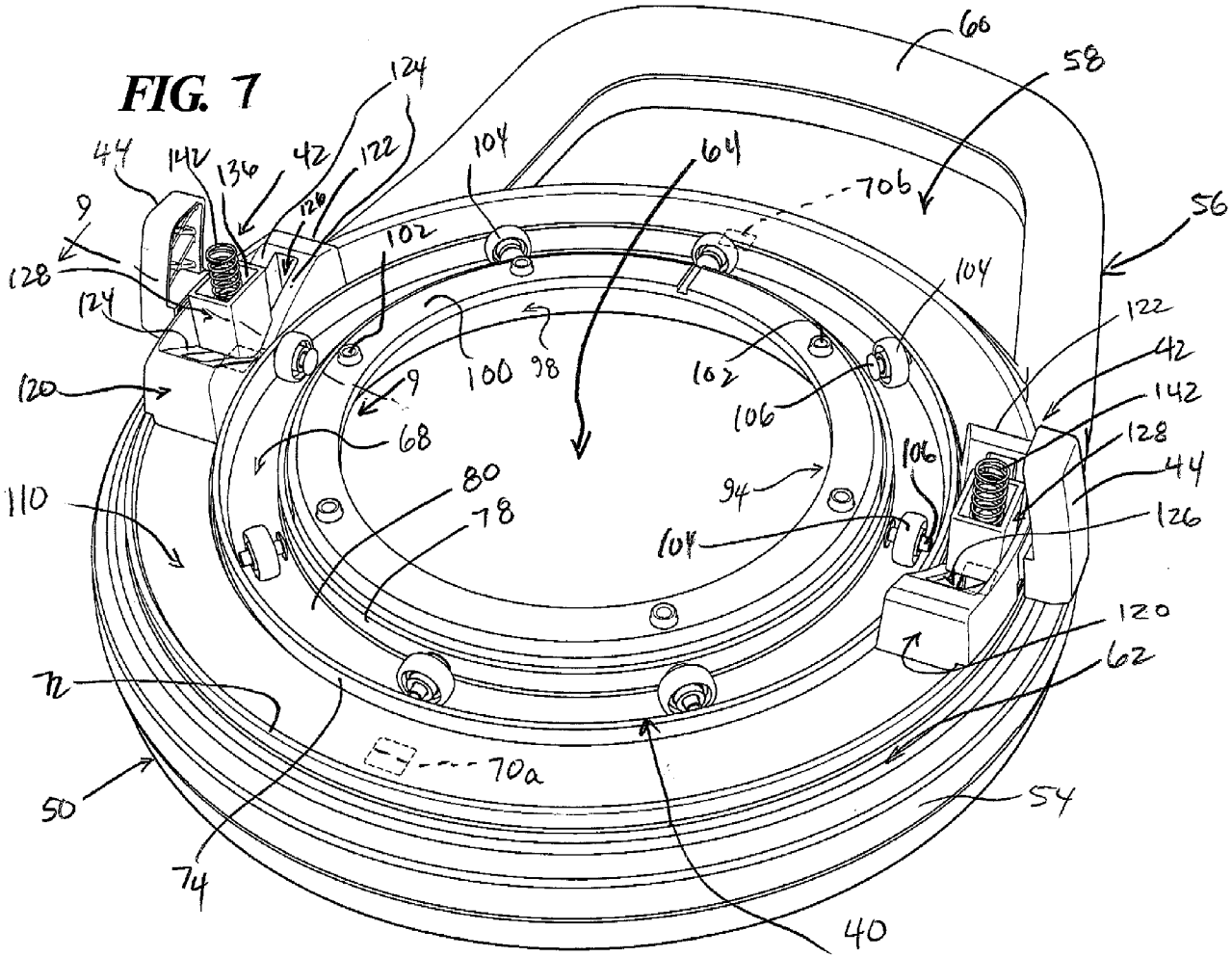
FIG. 7 shows the lower or stationary base part of the base assembly of FIG. 6 along with components of the swivel mechanism, exposed by a portion of the upper or swivel base part having been removed, and in a latched condition.
Figure 8:
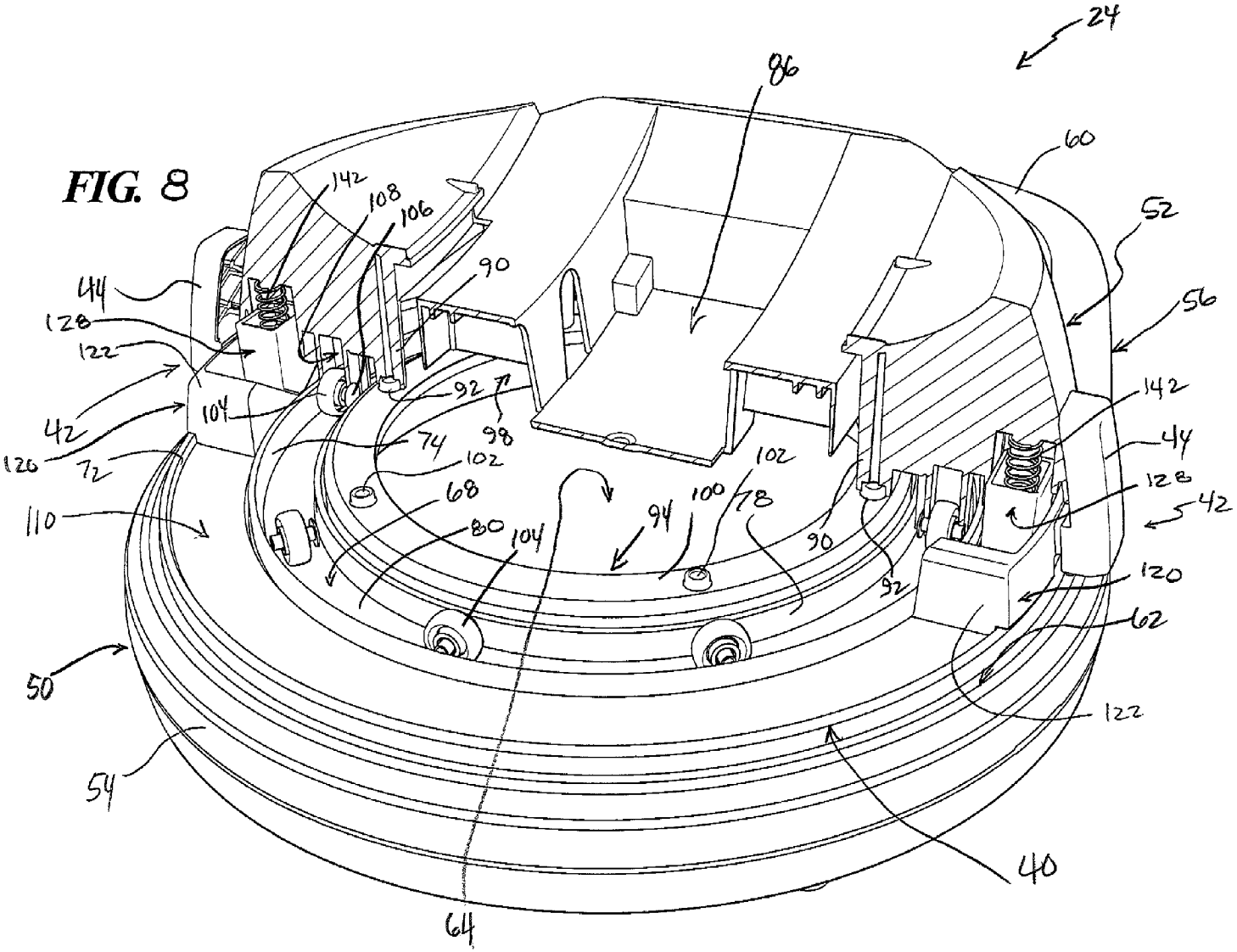
FIG. 8 shows a partial cutaway view of the base assembly of the child booster seat of FIGS. 1-5 and also in the latched condition of FIG. 7.
Figure 9:
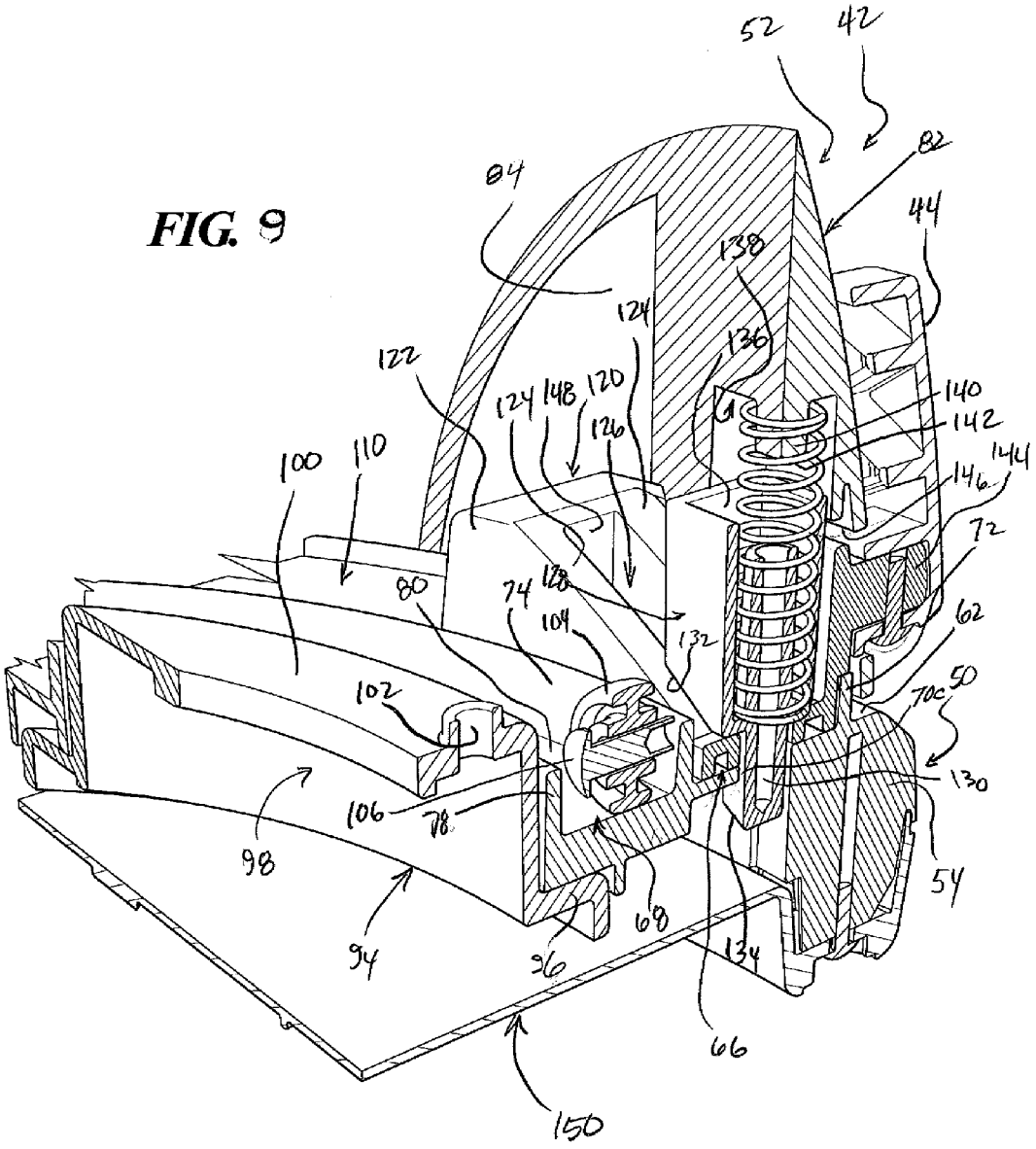
FIG. 9 shows a cross-section taken along line 9-9 of one of the latch mechanisms of the swivel mechanism shown in FIG. 7, the latch mechanism shown in a latched position.

FIGS. 7 and 8 show portions of the upper or swivel base part 52 mounted to the stationary base part 50 and FIGS. 8 and 9 show section views of the assembled stationary base part 50 and swivel base part. In this example, the upper or swivel base part 52 has several components including a housing portion 82 with a circumferential side wall 84. The underside interior of the housing portion 82 can be substantially hollow to reduce material usage, part cost, and weight. The side wall 84 can be tapered or frusto-conical to give the housing portion 82 an inverted bowl-like shape, as in this example. An upper side of the housing portion 82 is configured to include a receptacle, bracket, or seat mount 86 to receive and attach the seat 22. The underside of the housing portion 82 in this example is substantially open forming a substantially hollow interior of the housing portion. In this example, a plurality of standoffs 90 protrude downward from the housing portion 82 toward the stationary base part 50. The standoffs 90 are configured to receive fasteners 91 (see FIG. 5) in order to assemble the swivel base part 52, as described below. The standoffs 90 are circumferentially spaced apart on the underside of the housing portion 82. Free ends 92 of the standoffs 90 are arranged to form, in combination, an intermittent circular mounting surface concentric with the central opening 64 of the stationary base part 50 when assembled.

FIG. 5 shows the base assembly in exploded view and FIG. 7 shows the base assembly 24 with the housing portion 82 of the swivel base part 52 removed. The swivel base part 52 has a connecting ring 94 in this example. The connecting ring 94 is depicted in FIGS. 5 and 7-9 and has a bottom catch flange 96 that extends radially outward from a bottom edge of the ring (see FIG. 9). The connector ring 94 has a hub 98 that is smaller in diameter that the catch flange 96. The catch flange 96 extends radially outward from a lower edge of the hub 98. The diameter of the hub 98 is sized to fit within and through the internal or central opening 64 in the stationary base part 50. The connector ring 94 has an upper attachment flange 100 that projects radially inward from an upper edge of the hub 98. The attachment flange 100 includes a plurality of reinforced mounting holes 102 formed through the flange.

As shown in FIGS. 5 and 9, the mounting holes 102 align with the standoffs 90 and nest with or bear against the free ends 92 of the standoffs. The fasteners 91 can be inserted through the holes 102 into the standoffs 90 to join the connecting ring 94 to the housing portion 82. The connector ring 94 is fixed to the swivel base part 52 or housing portion 82 in this manner and is thus connected to the seat 22. The connector ring 94 will thus rotate or swivel with the seat 22 and relative to the stationary base part 50 when the booster seat 20 is assembled. The fasteners 92 can secure the connector ring 94 to the swivel base part 52 or housing portion 82 and can be screws, rivets, one-way screws, or other suitable fasteners or fastening means. When assembled, the stationary base part 50 and track arrangement will be captured between the swivel base part 52 and the catch flange 96. The catch flange 96 being beneath the inner race ring 68 of the track arrangement will prevent the swivel base part 52 and seat 22 from being lifted from the stationary base part 50. However, the catch ring 94 by not being directly fixed or fastened to the stationary base part 50 will allow the seat 22 and swivel base part 52 to rotate freely relative to the stationary base part.

With reference again to FIGS. 5 and 7-9, the swivel mechanism 40 resides in part on each of the base assembly 24 parts and in part between the base parts. The outer track ring 66, including the latch openings 70*a-d*, and the inner race ring 68 form part of the swivel mechanism 40. The housing portion 82 of the swivel base part 52 has a plurality of bearings, rollers, or, in this example, wheels 104 carried on the bottom side 88 of the housing portion 82. In this example, each wheel 104 is carried on an axle 106. The housing portion 82 has a plurality of mounting brackets 108 formed on or carried on the inside surface of the side wall 84. In this example, the axles 106 can snap, slide, or screw into the brackets 108 to mount the wheels 104 on the housing portion 82. The wheels 104 also form a part of the swivel mechanism 40 in this example. As shown in FIGS. 7 and 8, the wheels 104 reside in the inner race ring 68 and ride along the race surface 80 on the assembled booster seat 20. The wheels 104 are exposed on the bottom side 88 of the housing portion 82. The wheels 104 can be any type of friction reducing wheel, roller, bearing, or the like to provide easy swivel or rotation movement of the seat 22 and swivel base part 52 when moving the seat relative to the stationary base part 50.

As shown in FIGS. 4, 5, and 7-9, the aforementioned latch system of the swivel mechanism 40 is housed within the base assembly 24. The latch system in this example has two of the latch mechanisms 42 disposed generally opposite one another on the base assembly 24 and at the opposed sides of the seat 22. When either one, and only one, of the actuators 44 is actuated, both of the latch mechanisms 42 are released allowing the seat 22 and swivel base part 52 to be swiveled relative to the stationary base part 50. The latch system of the booster seat 20 resides as a part of the base assembly 24 in this example. The latch system generally has a latch ring or swivel ring 110 that carries and defines portions of the two latch mechanisms 42. Details of the latch mechanisms 42 are described below. The latch ring 110 is captured between the bottom side 88 of the housing portion 82 the outer track ring 66 on the stationary base part 50.

The latch ring 110 in this example has a bottom surface that can be smooth and convexly curved. The latch ring 110 seats in and can move adjacent or even glide or slide against the track surface 76 of the outer track ring 66. The aforementioned wheels 104 could also be replaced by sliders or gliders carried on the bottom side 88 of the housing portion 82. Alternatively, the latch ring 110 could carry some form of such rollers or wheel, if desired. In this example, the wheels 104 can be configured to create a gap between the track surface 76 of the outer track ring 66 and the bottom side 88 of the housing portion 82 to allow the latch or latch ring 110 to float between the two parts. This could reduce or eliminate sliding friction between the bottom surface of the latch ring 110 and the track surface 76 during movement.

In the disclosed example, the latch ring 110 is a contiguous one-piece ring, best illustrated in FIG. 5. In other examples, the latch ring 110 could be formed having two or more segments that are fastened or otherwise joined together. The disclosed latch ring 110 carries a pair of cam pens 120 that protrude from the top side of the ring. The cam pens 120 can also be separately fabricated parts that are attached to the latch ring 110 or can be contiguous integrally formed features of the ring. In the disclosed example, the cam pens 120 are integrally formed as part of the latch ring 110. The cam pens 120 form parts of the latch mechanisms 42. Each of the cam pens 120 has a body 122 with a V-shaped cam face on the top. Each cam face has two ramp surfaces 124 that face upward and that are angled downward, converging toward one another at the middle of the cam pen 120. Each cam pen 120 has a slot 126 vertically open through the body 122 and generally bisecting both of the ramp surfaces 124, as depicted in FIGS. 5, 7, and 9.

With reference to FIGS. 8 and 9, each latch mechanism 42 also has a latch shuttle 128 with a latch pin 130 protruding downward from an underside of the shuttle. The latch shuttle 128 also has a pair of angled surfaces or cam surfaces 132, one on either side of the latch pin 130 on the underside of the shuttle. The angles of the two cam surfaces 132 are configured to match the angle of the ramp surfaces 124, i.e., each has about the same V-shape. The cam surfaces 132 of the latch shuttle 128 rest against the ramp surfaces 124. The latch pin 130 is captured in and protrudes through the slot 126 in the body 122 of the corresponding cam pen 120. With the latch shuttle 128 seated at the lower apex of the ramp surfaces 124, a latch end 134 of the latch pin 130 protrudes beyond the slot 126 on the lower side of the cam pen 120, as can be seen in FIG. 9.

In this example, the top end of each latch shuttle has an opening 136 as shown in FIG. 9. Each latch shuttle 128 is captured in a pocket 138 provided on the housing portion 82. Each pocket 138 is sized to permit some vertical sliding movement of the latch shuttle 128. A guide post 140 is fixed within the pocket 138 and extends into the opening 136 on the shuttle 128, allowing the vertical movement but preventing lateral movement of the latch shuttle 128. Each latch shuttle 128, and thus each latch pin 130, is biased downward by a latch spring 142 that is carried on the guide post 140 and seated within the opening 136 in the shuttle. Thus, the springs 142 bias the latch shuttles 128 to the lower apex of the V-shape defined by the ramp surfaces 124. The latch shuttle 128 is free to move up and down within the pocket 138 within a limited range relative to the ramp surfaces 126. The range can be defined by the depth of the pocket 138, the depth of the opening 136 in the shuttle 128, and/or the length of the guide post 140 within the pocket. The latch pin 130 is also free to move along the slot 126 within a limited travel range, as discussed below. The travel range can be limited by the length of the sot 126 or some other stop surface or device provided as part of the latch mechanism 42 or swivel mechanism 40. The latch pin 130 is within the slot 136 between the ramp surfaces 124 on either side of the slot. The latch shuttles 128 otherwise can float within the cam pens 120.

In this example, each actuator 44 is fixed or secured to a radially outward facing side of the cam pen 120. The handles or actuators 44 can be connected to a stud or boss 144 on the body 122 of the cam pens 120 as shown in FIGS. 5 and 9. The actuators 44 can be attached using an adhesive, a heat bonding or welding process, a chemical bonding technique, suitable fasteners (as in this example), or the like. Actuator slots 146 are provided on opposed sides of the side wall 84 on the housing portion 82. The actuators 44 are exposed on the exterior of the side wall 84 while the cam pens 120 are positioned on the interior of the side wall. The bosses 144 extend through the actuator slots 146, which are longer than the bosses are wide. The actuators 44 are thus able to travel within a limited range relative to the side wall 84 in a lost motion type manner the bosses 144 bottom out against an end of the respective slot 146 or until some other part of the latch mechanisms contacts a stop.

FIGS. 7-9 show the latch system and swivel mechanism 40 in a latched condition and each latch mechanism 42 in a latched position. In this arrangement and position, the latch shuttles 128 are biased by the springs 142 to the lower apex of the ramp surfaces 124 in the cam pens 120. The latching ends 134 of the latch pins 130 are seated in an opposed pair of the latch openings 70*a*, 70*b* or 70*c*, 70*d* in the outer track ring 66. In the forward facing seat orientation of FIGS. 1 and 2 (or a rear facing orientation), the latch pins 130 reside in the slots 70*c* and 70*d*. In the side facing seat orientations represented in FIG. 3, the latch pins 130 reside in the slots 70*a*, 70*b*. In order to release the booster seat 20 to change the seat facing orientation of the seat 22, one must first release the latch system and latch mechanisms 42. In order to do so, one must release or disengage the latch pins 130 from the latch openings 70 so that the latching ends 134 are clear of the openings. The function of the swivel mechanism 40, latch system, and latch mechanisms 42 will now be described.

Figure 10:
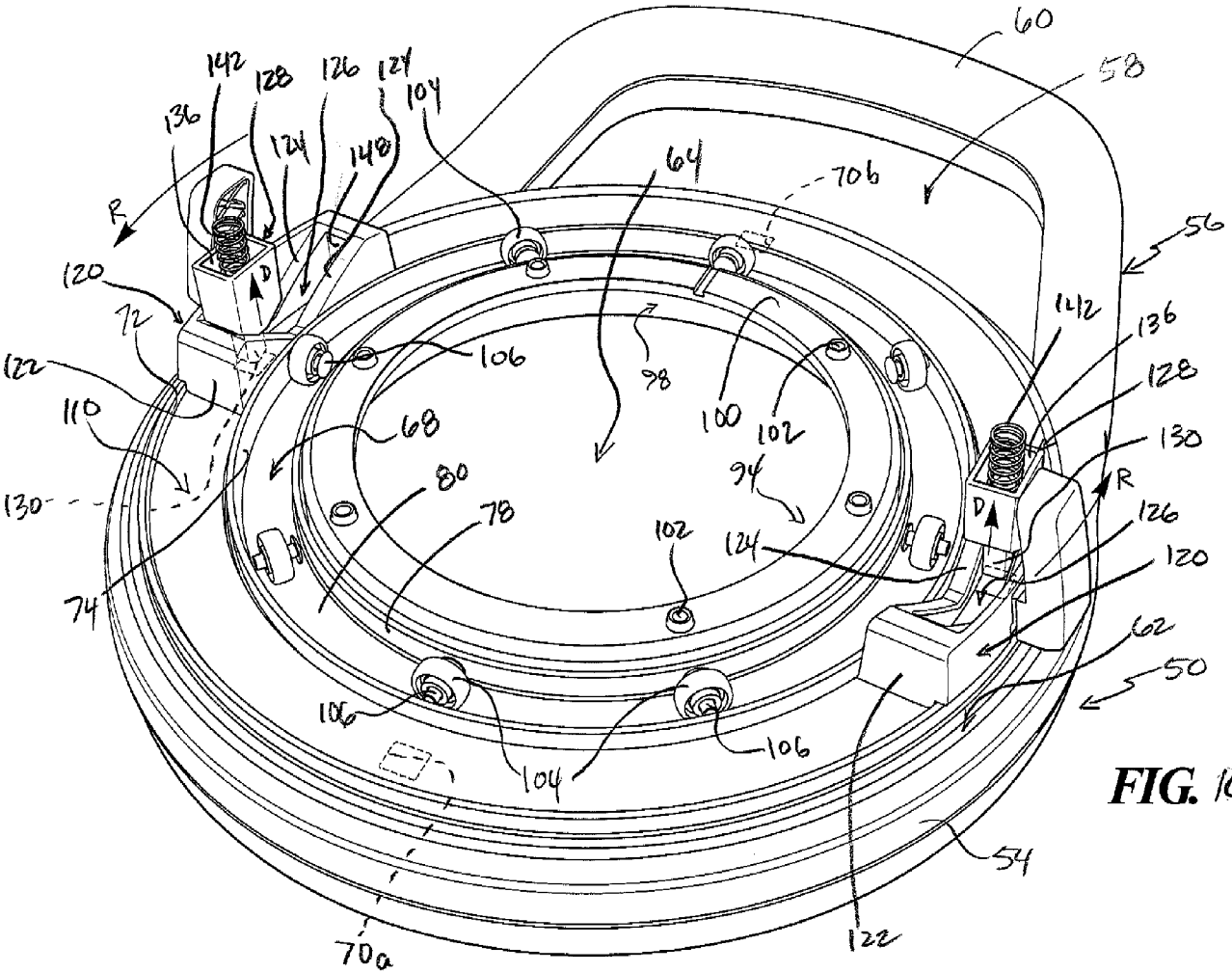
FIG. 10 shows the lower or stationary base part, the swivel mechanism components, and the portion of the upper or swivel base part depicted in FIG. 7 but in a released or unlatched condition.
Figure 11:
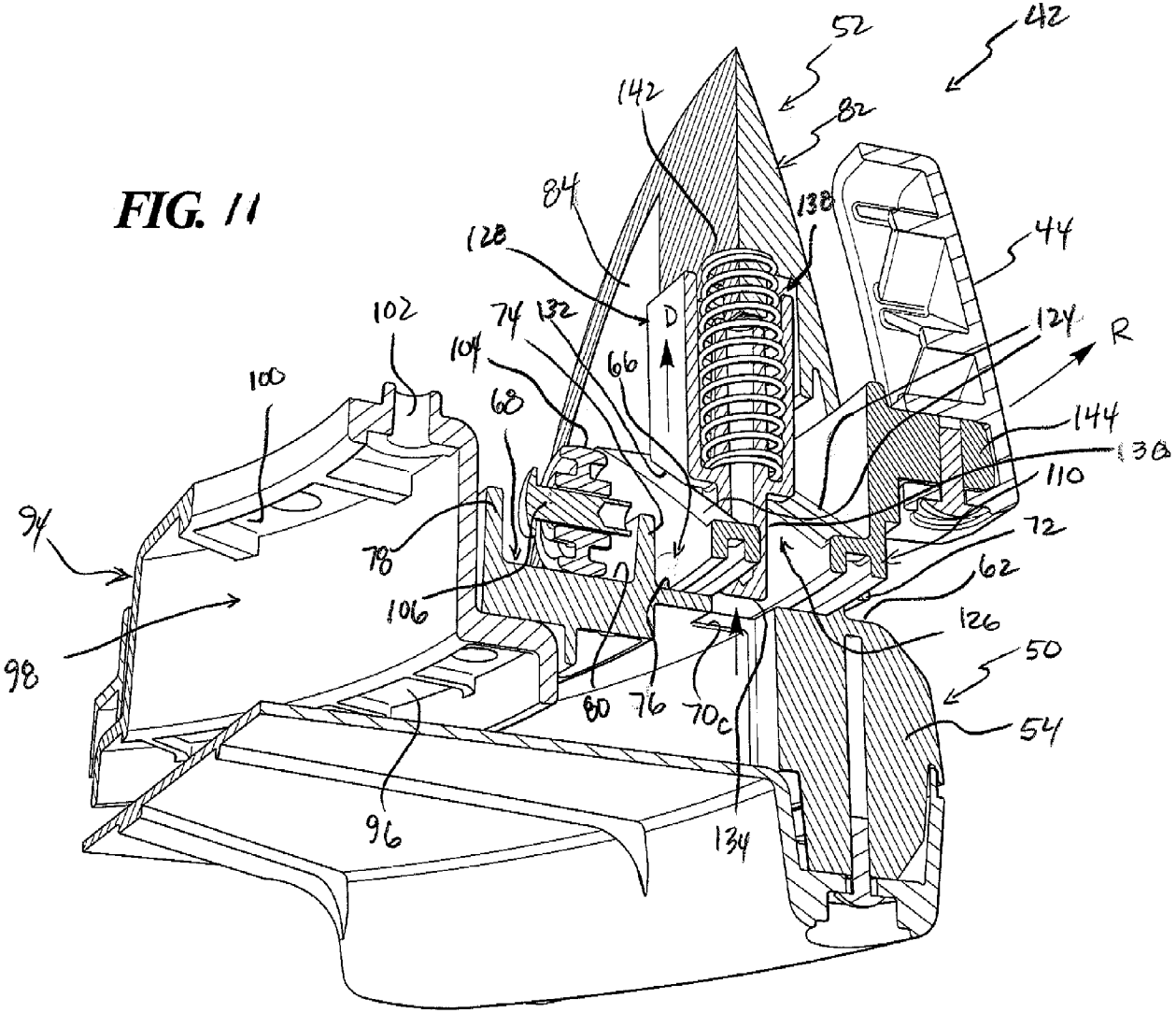
FIG. 11 shows the latch mechanism of FIG. 9, but in an unlatched or released position.

With reference to FIGS. 9 and 10, a user can grasp either one of the actuators 44 or handles on either of the latch mechanisms 42. The user can slide the selected actuator 44 circumferentially in the direction represented by the arrows R in FIG. 10 (or in the opposite direction if desired). This will slide both actuators 44 in the R direction. The entire swivel or latch ring 110, including the cam pens 120, will rotate relative to the outer track ring 66. Movement of the swivel or latch ring 110 and cam pens 120 moves the ramp surfaces 124 in concert. This movement raises both of the latch shuttles 128 against the bias force of the springs 142 in the direction of the arrows D, which moves the latch pins 130 upward, withdrawing and disengaging the latching ends 134 from the latch openings. This occurs as the latch shuttle cam surfaces 132 bear against and ride up the ramp surfaces 124 on one side of the cam pen 120, as depicted in FIG. 11. The user need only overcome the spring force of the two springs 142 when actuating either one of the actuators 44. Once the latching ends 134 are clear of the latch openings 70, the swivel mechanism 40 and latch system is in a released or unlatched condition and the latch mechanisms 42 are in an unlatched position as shown in FIG. 11.

The user can then further move the selected actuator 44 in the R direction. The bosses 144 may eventually bottom against the ends of the actuator slots 146, the latch shuttles 128 may eventually bottom against a side or stop surface 148 at the end of the slot 126, and/or some other stop surfaces may contact one another. As this occurs, further rotation of the selected actuator will rotate or swivel the seat 22 and the swivel base part 52 relative to the stationary base part 50. The user can rotate the seat 22 to a new desired position either continuing to use the selected actuator or by grabbing any other part of the seat 22 or swivel base part 52. The wheels 104 can roll along and against the race surface 80 to make rotation of the seat 22 relatively easy. The latch springs 142 will fire the latch pins 130 into the next adjacent or desired latch openings 70*a*, 70*b* or 70*c*, 70*d* when the latch pins align with the openings in the outer track ring 66.

Figure 12:
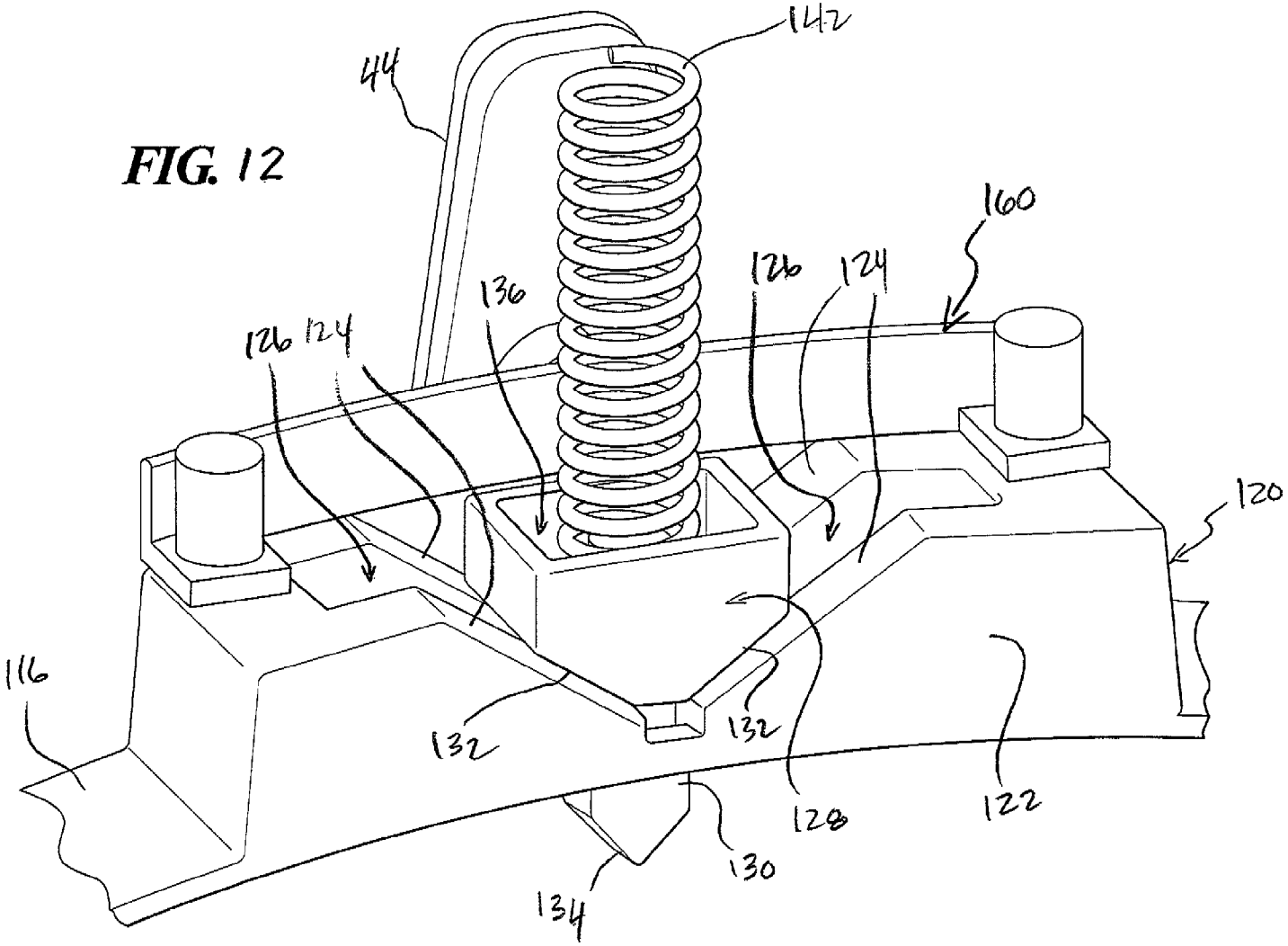
FIG. 12 shows one alternate example of a latch mechanism for the swivel mechanism of a child booster seat constructed in accordance with the teachings of the present disclosure.

As noted above and as will become evident to those having ordinary skill in the art, the specific configuration and construction of the latch system and latch mechanism components can be varied from the example described above. FIG. 12 shows just one of many possible modifications that can be made to the latch mechanisms 42, for example. Other modifications are certainly within the scope of the present disclosure. In FIG. 12, the cam pen 120 has a separate bar 160 connected to the body 122. The bar 160 can be fastened to a portion of the body. The actuator 44 can be mounted to the bar 160 instead of the outer side of the body as in the prior example. FIG. 11 otherwise shows components for the latch mechanism 42 that are either similar to or the same as those described above and provides a good illustration of the latch shuttle 128, cam pen 120, ramp surfaces 124, and cam surfaces 132.

Other modifications can be made to the latch ring, the latch mechanisms, the swivel race and track arrangement, the base assembly, and the like. The modifications can increase or decrease the number of required parts, to increase or decrease the component and fabrication complexity, to increase or decrease the part cost, and/or the like. In one example, the swivel or latch ring 110 can be formed as two identical, half circle parts that are joined or connected to one another. The two parts could be secured together at their respective ends using fasteners, a snap connection, or the like. Each of the two ring parts could have a latch mechanism thereon. Details of the various components disclosed herein can be changed. Push buttons instead of the actuators 44 can be provided on the base assembly 24 and can be used to lock into a moving part to release two latch mechanisms. Two or more actuation triggers can be provided, all connected with cables to one latch mechanism. The disclosed swivel or latch ring could have multiple actuators or handles but only one latch mechanism. The disclosed handles or actuators could instead be pushed or pulled whereby and the ramp surfaces then raise the latch pins to disengage them. A bottom cover 150 (see FIG. 9) can be provided and attach to the bottom of the stationary base part 50. The cover 150 can close off the hollow interior of the base assembly, the central opening 64, and the at least partially exposed underside of the housing portion 82.

In both of the examples noted above, the entire swivel or latch ring 110 is fixed to both of the handles or actuators 44. Thus, actuating either one of the actuators 44 will rotate the entire swivel or latch ring 110 and release both latch mechanisms simultaneously. Thus, a user can actuate and release all of the latch mechanisms of the latch system, if two or more mechanisms are provided, while using only one hand. The user can also rotate the seat 22 also using only one hand, which can conveniently be the same hand that released the latch system. The user can do so in either rotational direction of the booster seat 20. The disclosed booster seat can be released and re-positioned with one hand. Rotating the booster seat will provide easier access to the child seated in the seat. The disclosed booster seat design is intended for one-handed operation. The caregiver can have the other hand free. The actuators and associated swivel latches are parts that move with the swiveling seat so that the caregiver can use the actuator, handle, or latch to both release the seat and swivel the seat orientation.

The disclosed booster seat design solves the aforementioned problems by putting the swivel mechanism and latch system components and actuators on and into the moving components so that only one hand is needed to turn the seat. This is true even though the disclosed booster seat 20 has two separate latch mechanisms 42, one on each side of the seat. Having two latches provides a robust latch or connection to secure the seat in a selected orientation. The selected swivel handle or actuator 44 is pushed or pulled from one side, which actuates both swivel latch mechanisms to allow the seat to turn. The disclosed booster seat 20 can turn at least 180 degrees from one side facing orientation to the other. The disclosed booster seat 20 can latch in at least three different seat facing orientations include a forward facing, left side facing, and right side facing orientation. The seat may also be capable of turning up to 270 degrees or more, if desired, and/or could latch in a rear facing orientation as well. However, the booster seat can be provided with a lock-out mechanism or one or more stops to prevent turning the seat completely around 360 degrees, which could be potentially less safe. One unique feature of the disclosed booster seat 20 is that only one swivel handle or actuator needs to be used to release both latches and to turn the seat all in one motion or actuation and with one hand.

The disclosed examples provide specific combinations of parts, components, features, and aspects. It is within the scope of the present disclosure and claims to permit different combinations of those parts, components, features, and aspects. It is possible that any one or more of the disclosed parts, components, features, and aspects of the booster seat can be used separately or in combination with any other one or more of the disclosed parts, components, features, and aspects.

Although certain booster seats, swivel mechanism, latch system, latch mechanism, and other components and methods have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child booster seat comprising:

a base assembly comprising a stationary base part and a swivel base part movably coupled to the stationary base part;

a seat carried on the swivel base part, the seat and swivel base part rotatable relative to the stationary base part between at least two different seat facing orientations; and a latch system comprising at least one latch mechanism and two or more actuators spaced apart on the child booster seat, each actuator operably coupled to the at least one latch mechanism, wherein the latch system comprises a circumferential latch ring, the latch ring carrying a cam pen of the at least one latch mechanism, wherein a latch pin is seated in the cam pen; and wherein, when any selected actuator of the two or more actuators is actuated, the latch ring and the cam pen move which in turn moves the latch pin and the at least one latch mechanism is released allowing the seat to be swiveled relative to the stationary base part.

2. A child booster seat according to claim 1, further comprising two of the latch mechanisms disposed generally opposite one another on a portion of the child booster seat, each of the two latch mechanism having one of the two or more actuators operably coupled thereto.

3. A child booster seat according to claim 1, wherein the stationary base part is a lower base part and the swivel base part is an upper base part mounted on a top side of the stationary base part.

4. A child booster seat according to claim 3, wherein the seat and the swivel base part are supported by the stationary base part.

5. A child booster seat according to claim 1, wherein any selected one of the two or more actuators can be actuated with one hand whereby the seat can be rotated with the one hand.

6. A child booster seat according to claim 1, wherein the latch ring and cam pen are formed as one contiguous integral part.

7. A child booster seat according to claim 1, further comprising two of the latch mechanisms and two of the actuators, one actuator operably coupled to a respective one of the latch mechanisms.

8. A child booster seat according to claim 7, further comprising:

a latch ring carrying two cam pens, one cam pen for each of the latch mechanisms, the latch ring operably coupled to each of the two or more actuators;

two latch pins, one seated in each of the cam pens; and ramp surfaces on the cam pens, the ramp surfaces configured to move the corresponding latch pins between a latched position and an unlatched position by selectively actuating a selected one of the two actuators.

9. A child booster seat according to claim 1, wherein the latch system further comprises a circumferential latch ring captured between the stationary base part and the swivel base part.

10. A child booster seat comprising:

a base assembly comprising a stationary base part comprising a track ring; and a swivel base part movably coupled to the stationary base part;

a seat carried on the swivel base part, the seat and swivel base part rotatable relative to the stationary base part between at least two different seat facing orientations; and a latch system comprising:

a latch ring captured between the stationary base part and the swivel base part over the track ring;

a plurality of latch mechanisms; and a plurality of actuators, each of the plurality of latch mechanisms having one of the plurality of actuators operably couple thereto, the plurality of actuators spaced apart on the child booster seat, wherein each of the plurality of actuators is fixed to a portion of the latch ring and is exposed on an exterior of the base assembly, and wherein, when any selected actuator of the plurality of actuators is actuated, the plurality of latch mechanisms is released allowing the seat to be swiveled relative to the stationary base part.

11. A child booster seat according to claim 10, wherein the plurality of latch mechanisms comprises two latch mechanism disposed opposite one another on the base assembly.

* * * * *